US007696891B2

(12) United States Patent
Whitney

(10) Patent No.: US 7,696,891 B2
(45) Date of Patent: Apr. 13, 2010

(54) SYSTEM AND METHOD FOR SUPPRESSING THE SPREAD OF FIRE AND VARIOUS CONTAMINANTS

(75) Inventor: Paul K. Whitney, Lynchburg, VA (US)

(73) Assignee: FireKiller Technologies, LLP, Lynchburg, VA (US)

( * ) Notice: Subject to any disclaimer, the term of this patent is extended or adjusted under 35 U.S.C. 154(b) by 0 days.

(21) Appl. No.: 11/956,955

(22) Filed: Dec. 14, 2007

(65) Prior Publication Data

US 2008/0197204 A1 Aug. 21, 2008

Related U.S. Application Data

(63) Continuation-in-part of application No. 10/462,279, filed on Jun. 16, 2003, now Pat. No. 7,102,529.

(60) Provisional application No. 60/388,689, filed on Jun. 14, 2002.

(51) Int. Cl.
*G08B 17/10* (2006.01)

(52) U.S. Cl. ..... 340/628; 340/632; 340/693.6

(58) Field of Classification Search ..... 340/628, 340/629, 630, 632

See application file for complete search history.

(56) References Cited

U.S. PATENT DOCUMENTS 4,308,911 A * 1/1982 Mandl ..... 165/209
4,363,031 A 12/1982 Reinowitz
4,558,181 A 12/1985 Blanchard et al.
4,763,115 A 8/1988 Cota
4,944,216 A 7/1990 McCutchen
4,977,818 A 12/1990 Taylor et al.
5,198,809 A 3/1993 Day
5,568,535 A 10/1996 Sheffer et al.
5,576,739 A * 11/1996 Murphy ..... 340/3.4
5,793,296 A * 8/1998 Lewkowicz ..... 340/632
5,801,940 A * 9/1998 Russ et al. ..... 700/9
5,838,243 A * 11/1998 Gallo ..... 340/632
5,850,180 A 12/1998 Hess
5,945,924 A 8/1999 Marman
5,950,150 A 9/1999 Lloyd et al.
5,979,565 A 11/1999 Wicks et al.
6,061,430 A 5/2000 Miller et al.
6,118,381 A * 9/2000 James ..... 340/577
6,215,404 B1 4/2001 Morales
6,281,790 B1 8/2001 Kimmel et al.
6,384,723 B1 5/2002 Keeler et al.
6,474,086 B1 11/2002 Liu
6,873,256 B2 3/2005 Lemelson et al.
6,989,757 B2 * 1/2006 Geoffrey et al. ..... 340/632
7,169,039 B2 * 1/2007 Oppedisano et al. ..... 454/256
2002/0183001 A1 * 12/2002 Holter et al. ..... 454/239

OTHER PUBLICATIONS

1500 Series, Fire Alarm Control Panels, ESL Product Information Bulletin, 2001.

(Continued)

*Primary Examiner*—Toan N Pham
(74) *Attorney, Agent, or Firm*—Kilpatrick Stockton LLP

(57) ABSTRACT

Systems and methods for suppressing the spread of fire, fire-related toxins, and other biological and chemical hazards are disclosed. One described system includes a thermostat incorporating an HVAC interface in communication with a residential HVAC system, a receiver operable to receive a signal indicating the presence of a contaminant from an environmental condition detector, and a processor in communication with the receiver and the residential HVAC system and operable to receive the signal from the receiver, and in response, send a signal to the HVAC interface to cause the residential HVAC system to be shut down.

15 Claims, 9 Drawing Sheets

OTHER PUBLICATIONS

Patent Cooperation Treaty, International Search Report, International Application No. PCT/US03/18850, mailed Dec. 1, 2003.

Patent Cooperation Treaty, International Search Report, International Application No. PCT/US2007/012954, mailed Nov. 21, 2008.

Patent Cooperation Treaty, Preliminary Report on Patentability, International Application No. PCT/US2007/012954, mailed Dec. 31, 2008.

United States Patent and Trademark Office, Office Action, U.S. Appl. No. 10/462,279, mailed Nov. 16, 2005.

* cited by examiner

SYSTEM AND METHOD FOR SUPPRESSING THE SPREAD OF FIRE AND VARIOUS CONTAMINANTS

CROSS REFERENCE TO RELATED APPLICATIONS

This application is a continuation-in-part of U.S. application Ser. No. 10/462,279, entitled "System and Method for Suppressing the Spread of Fire and Various Contaminants," filed Jun. 16, 2003, which claims priority to U.S. Provisional Patent application Ser. No. 60/388,689, filed Jun. 14, 2002, and this application claims priority to U.S. application Ser. No. 11/491,465, entitled "System and Method for Suppressing the Spread of Fire and Various Contaminants," filed Jul. 21, 2006, which is a divisional application of U.S. application Ser. No. 10/462,279, the entirety of all of which are hereby incorporated by reference.

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

FIELD OF THE INVENTION

The present invention relates generally to the suppression of fire and of the spread of chemical and biological contaminants. The present invention more particularly relates to interconnecting environmental condition detection equipment to a heating ventilation and air conditioning system.

BACKGROUND

According to the National Fire Prevention Association, in the United States in 2000, a residential fire occurred every 83 seconds (www.nfpa.org). These fires have the potential to affect, displace, or injure thousands of people a day. And over thirty-four hundred people died in these fires. The fires also caused over five billion dollars in property loss, resulting in over four billion dollars paid by the insurance industry under homeowner's insurance policies. (Insurance Information Institute, New York, N.Y., www.iii.org).

Often, a homeowner can prevent a fire from occurring. In the fires that cannot be prevented, the homeowner can take steps to minimize the consequences. One way in which a homeowner can minimize any damage that may occur is to install a smoke, heat, carbon monoxide, or other detector. The detector warns the occupants, and perhaps a security agency, that the conditions present in a fire are occurring so that the homeowner can undertake the proper response, such as contacting the fire department, extinguishing the fire, and leaving the residence.

Unfortunately, simply notifying the homeowner or security agency that a rapidly progressing fire is occurring may not be enough to save the life of the homeowner or to avoid damage to the house. A fire needs time to develop. In many cases, a residential fire initially emits relatively little heat and exhausts the supply of combustion air in a room in a residence very quickly. Unfortunately, even a relatively low-temperature fire quickly raises the temperature of a room by several degrees. When the temperature rises, the thermostat may trigger the heating, ventilation, and air conditioning (HVAC) system fan to start, forcing air into the room and providing combustion air necessary for the fire to grow and spread. In conventional homes, this progression of the fire stops only when the power fails, which usually only occurs after the fire department removes the power company's meter.

A similar situation occurs in large commercial buildings. Often, in a commercial building, heat or smoke detectors are connected to a heating ventilation and air conditioning (HVAC) system. When the detectors indicate that the environmental conditions of a fire are present, the detectors or a master controller signal the HVAC system to cease functioning or to close the air ducts feeding air to the specific parts of the building from which the warning is emanating. These air ducts are normally used to control the distribution of air in order to control the temperature in various parts of the building. The ability to use them to starve a fire of combustion air is a fortunate consequence of their installation. See, e.g., U.S. Pat. No. 5,945,924. Unfortunately, the types of duct control mechanisms used by conventional commercial HVAC systems are not present in residential HVAC systems. Conventionally, systems such as these are not required unless a building requires an HVAC system providing a heating and cooling capacity of at least five tons per unit.

Large commercial buildings may include other mechanisms for suppressing or extinguishing a fire. For example, many commercial buildings include sprinkler systems. Also, the computer rooms of a business may include a halon system to deprive a fire of combustion air. These systems are rarely present in residential buildings.

Another threat posed to commercial and residential building alike is the danger of a biochemical hazard, such as mold or anthrax, spreading through a building. In conventional large commercial buildings, a detector designed to detect specific biological materials can be integrated into the same controls used for the suppression of fire. This type of safeguard is not present in conventional residential and small commercial buildings.

Conventional residential and small commercial buildings have relatively simple HVAC systems. Generally, one or two compressors cool a liquid contained in tubing over which air is forced by a fan. These systems are called forced air systems. The cooled air then passes through ducts and out various registers located throughout the residence. The registers may be closed manually, but conventional residential HVAC systems do not include automated mechanisms for closing individual ducts or registers. Therefore, no conventional mechanism exists for suppressing fire by shutting off the air supply in a residence.

SUMMARY

Embodiments of the present invention provide systems and methods for suppressing the spread of fire, fire-related toxins, and other biological and chemical hazards by shutting off the fan in a heating, ventilation, and air conditioning (HVAC) system when environmental factors have been detected that indicate the hazard. In one embodiment, the a system for suppressing the spread of contaminants comprises a thermostat incorporating an HVAC interface in communication with a residential HVAC system, a receiver operable to receive a signal indicating the presence of a contaminant from an environmental condition detector, and a processor in communication with the receiver and the residential HVAC system and operable to receive the signal from the receiver, and in response, send a signal to the HVAC interface to cause the residential HVAC system to be shut down.

Embodiments of the present invention provide a simple, inexpensive, and very effective mechanism for minimizing the damage caused by fire, particularly the horrendous loss of life. Embodiments of the present invention provide many advantages over conventional systems. An embodiment of the present invention is a hard-wired system, eliminating many of the potential points of failure present in conventional systems. Also, by stopping the flow of air through the air handler of the HVAC system, an embodiment of the present invention eliminates much of the potential for damage to the air handler. Avoiding damage to the air handler saves the insurance company and the homeowner expense and saves the restoration contractor time an effort. Also, since an embodiment of the present invention is both simple and inexpensive, embodiments may be utilized in both new and retrofit applications.

Further details and advantages of the present invention are set forth below.

BRIEF DESCRIPTION OF THE FIGURES

These and other features, aspects, and advantages of the present invention are better understood when the following Detailed Description is read with reference to the accompanying drawings, wherein.

DETAILED DESCRIPTION

Embodiments of the present invention provide systems and methods for suppressing the spread of fire, fire-related toxins, and other biological and chemical hazards by shutting off the fan in a residential-type heating, ventilation, and air conditioning (HVAC) system. The residential-type HVAC system may be present in a home or small office environment. In an embodiment of the present invention, a detector that detects the environmental conditions normally present during a fire is linked to a controller. The controller shuts off a fan in a forced air residential HVAC system, depriving the fire of the combustion air necessary to grow and spread and stopping the advance and transfer of fire-related toxins and other biological and chemical hazards. In various embodiments, the controller may be a simple relay installed internally or externally to the HVAC system. In other embodiments, the thermostat incorporates the controller. Embodiments of the present invention may include various additional features, including an electrical power shut off and one or more of various notification mechanisms.

A fire consists of an ignition source, fuel and oxygen. For the fire to continue, it only needs fuel and oxygen. In a home there are many sources of fuel for the fire to feed from. But oxygen is a limited source in a room until the air handler turns on. When the air handler turns on, oxygen is forced into the fire like a turbo charger. This also damages the air handler with hot gasses being sucked into it. Instead of the fire expanding at a slow rate it is accelerated reducing the amount of time the occupants have to escape.

Figure 1:
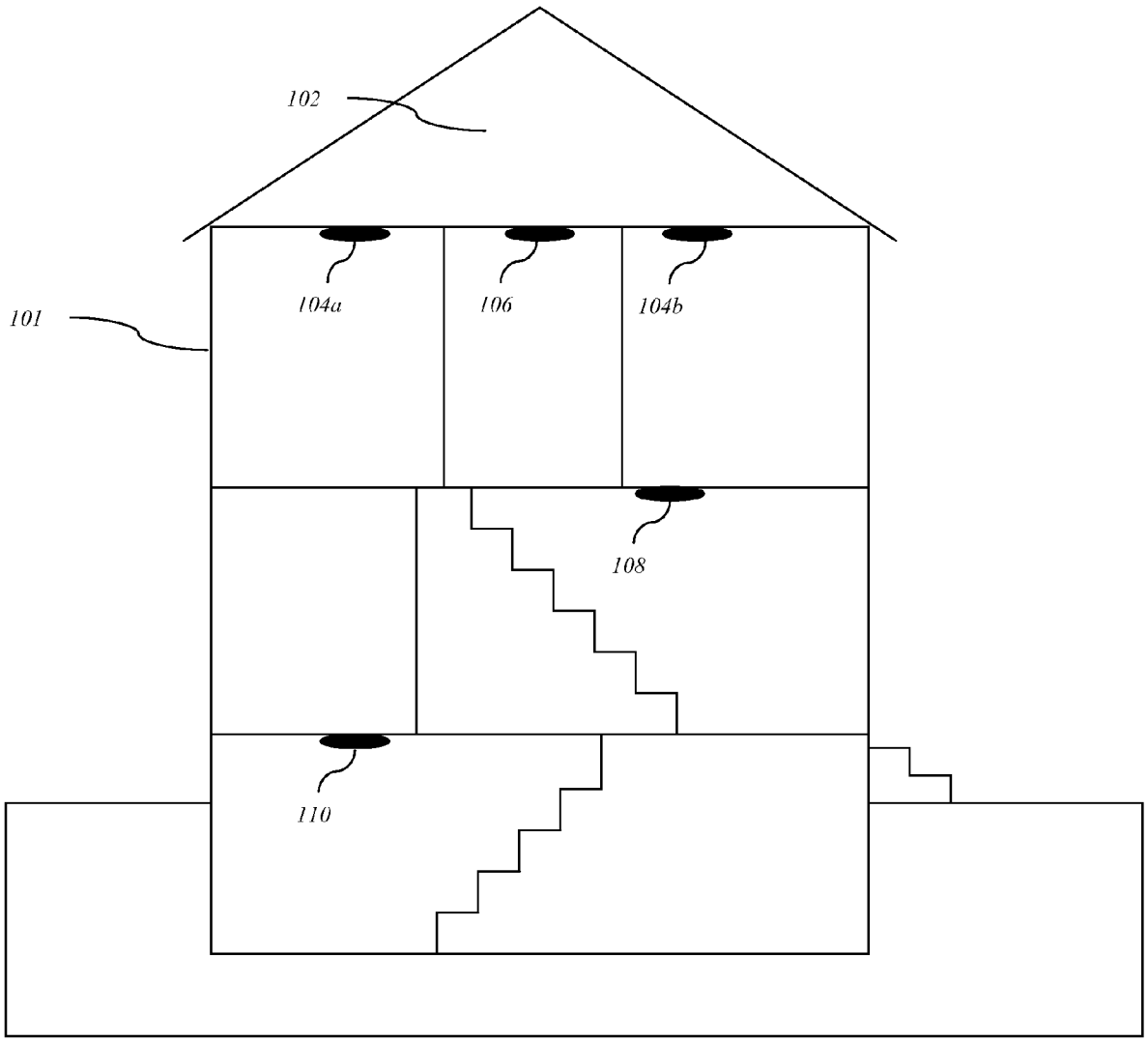
FIG. 1 is a block diagram illustrating the layout of smoke detectors in a conventional residential setting in an embodiment of the present invention.

FIG. 1 is a block diagram illustrating the layout of smoke detectors in a conventional residential setting in an embodiment of the present invention. Many conventional building codes require that smoke detectors be installed on each level of a new residence, such as residence 101 shown in FIG. 1. The codes do not require a smoke detector in the attic space 102. The codes require smoke detectors in each of the bedrooms 104*a* and 104*b* as well as in the hallway between bedrooms 106. On other levels and in other areas of the residence 101, only one detector is required, such as living room smoke detector 108 and basement smoke detector 110. While the embodiment shown in FIG. 1 illustrates the use of smoke detectors, any type of environmental condition detector may be used. Examples of such devices include a carbon monoxide or dioxide detector, a sprinkler system, or security system.

Figure 2:
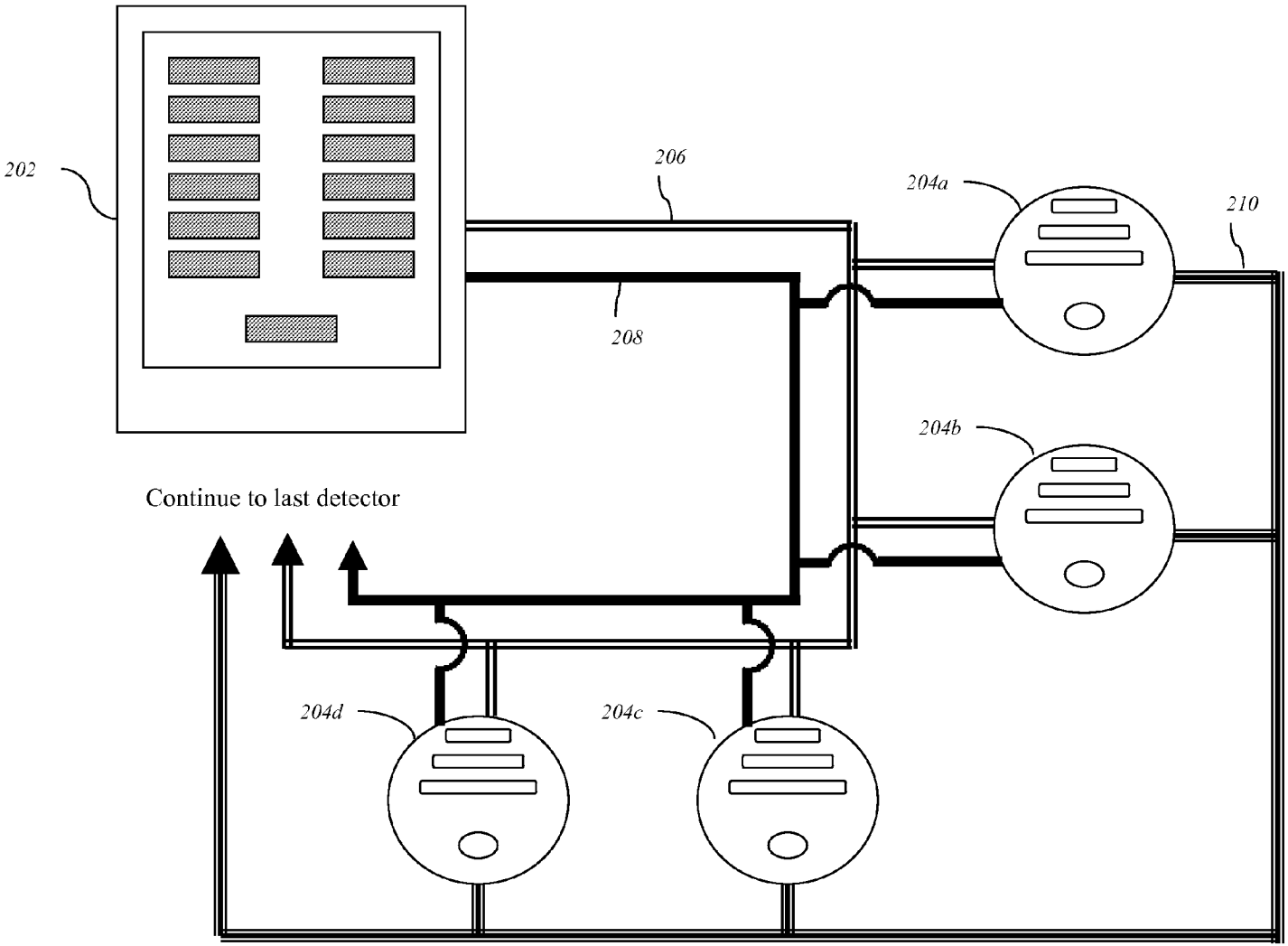
FIG. 2 is a wiring diagram illustrating the wiring of interconnected smoke detectors in an embodiment of the present invention.

To ensure that all persons in a residence are aware of the presence of a fire in the residence, codes also require that each of the smoke detectors be interconnected. FIG. 2 is a wiring diagram illustrating the wiring of interconnected smoke detectors in an embodiment of the present invention. The electrical panel 202 in the house provides power to the smoke detectors. Power for each smoke detector is on one circuit utilizing 110-volt household voltage via neutral wire 206 and hot wire 208. In addition, a third wire 210 provides the interconnect signaling between the detectors. In the embodiment shown, the interconnect wire 210 operates at 110-volts as well.

The interconnected smoke detectors in FIG. 2 are merely illustrative. Many alternatives exist for interconnecting the smoke detectors. Conventional smoke detectors may utilize a battery backup (not shown). Also, the interconnect voltage may vary. For example, conventional systems use 9, 12, 15, or 24-volt interconnect voltages. Also, various types of detectors may be interconnected, including, for example, heat and carbon monoxide detectors.

Figure 3:
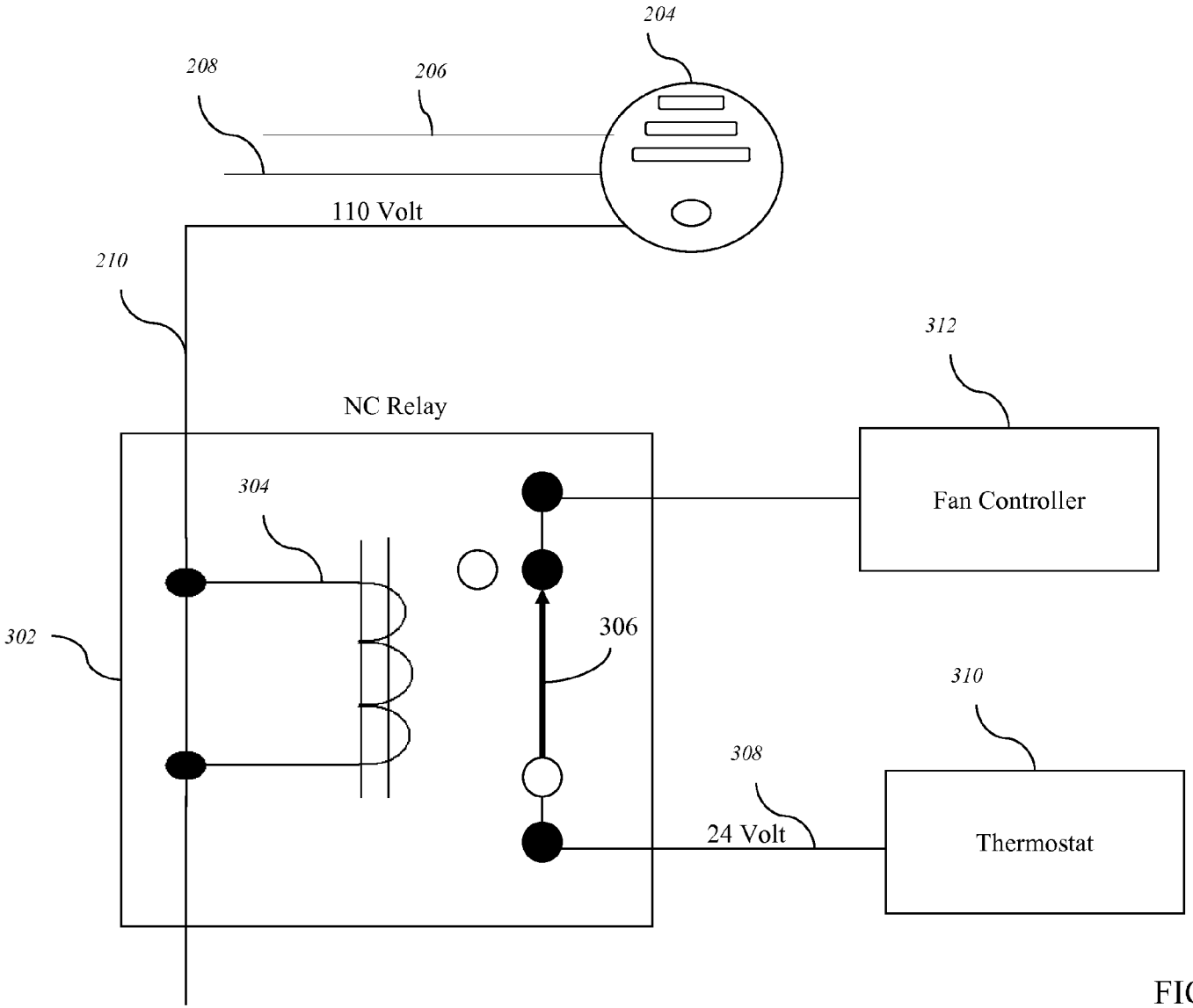
FIG. 3 is a wiring diagram illustrating a relay as the controller for an HVAC unit in an embodiment of the present invention.

In an embodiment of the present invention, the interconnect wire from the smoke detectors or the output from a single smoke detector is connected to a controller, which is connected to the HVAC system. FIG. 3 is a wiring diagram illustrating utilizing a relay as a controller for an HVAC unit in an embodiment of the present invention.

A relay is a switch that is operated by an electrical magnet or coil. Current flowing through one circuit energizes the coil, which causes the switch to turn a current in the second circuit on or off. The relay can operate the switch in response to a small change in current or voltage supplied to the coil. Various types of relay exist. In a normally closed (NC) relay, the switch is on until the coil is energized.

The relay shown in FIG. 3 is a NC relay 302. In the embodiment shown, the smoke detector 204 has a neutral 206, hot 208, and interconnect wire 210 shown. The interconnect wire 210 carries 110-volts. The interconnect wire 210 is wired to a 110-volt coil 304 in the NC relay 302. The switch 306 in the relay 302 is wired to a 24-volt wire 308 that is also wired to the thermostat 310. The switch 306 is also wired to the fan controller 312 of the HVAC system (not shown).

When smoke is detected by the smoke detector 204, the 110-volt signal from the interconnect wire 210 energizes the coil 304, turning the relay 302 on, and opening the relay contacts at the switch 312. Opening the relay contacts opens or interrupts the 24-volt circuit from the thermostat 310 to the fan controller 312, which shuts off the fan (not shown). In one embodiment of the present invention, once the relay contacts open, they remain open until a reset (not shown) is activated.

Although in the embodiment shown, the relay 302 includes a 110-volt coil 304 and switches a 24-volt current 306, various combinations of currents may be utilized in an embodiment of the present invention, such as 9, 24, and 220-volt coils and various control voltages. In one embodiment of the present invention, the relay includes various switches, such as pin switches, that can be utilized to vary the voltage utilized by the coil.

In the embodiment shown in FIG. 2, the coil 304 causes the switch 306 to shut off the fan. In another embodiment, a time delay reset (not shown) is also connected to the coil and causes the relay to pause before shutting off the fan, helping to reduce problems associated with false alarms. Another embodiment includes a reset button (not shown) so that the homeowner or technician can reset the relay after an alarm.

In one embodiment, the relay 302 and the smoke detector interconnect 210 are not directly connected. Instead, the relay 302 is wired to another device, such as an audio detector that senses when the smoke or other detector is activated and in response energizes the coils.

Embodiments of the present invention may vary in how they implement the relay shown in FIG. 3. For example, in one embodiment, the relay shown in FIG. 3 is a separate component that is wired to the thermostat, smoke detector interconnect, and fan control. An embodiment as a separate component allows for the component to be installed in both new and existing HVAC systems.

In another embodiment, the relay is built into the HVAC system. Relays such as the relay 302 shown in FIG. 3 are commonly installed in conventional residential HVAC systems. In one embodiment, an existing relay is used to implement a method of the present invention. In another embodiment, the relay 304 is installed in the HVAC system specifically to be connected to the interconnect circuit 210.

In yet another embodiment, the relay is built into the thermostat. In conventional schematics of thermostats, the low-voltage outputs are labeled R (Red), W (White), Y (Yellow), and G (Green). The 24-volt circuit 308 shown in FIG. 3 is commonly referred to as the R-circuit. However, any output used to control the fan of the residential HVAC system can be connected to the relay in an embodiment of the present invention.

In an embodiment in which the relay is built into the thermostat or the HVAC system, the wiring of the system is very simple. Because the relay is an NC relay, unless voltage is supplied to the coil 304 the 24-volt current will flow normally to the fan control. Therefore, the relay 302 may be installed in any thermostat or HVAC system even if the interconnect 210 is not initially wired to the thermostat 310. Once the interconnect is attached, the functionality of shutting off the fan becomes operative.

In one embodiment of the present invention, the relay is wired to a shut off on the residential electric panel. The electric panel disconnect helps to prevent or suppress fires caused by electrical faults. The electric panel shut off may be combined with the HVAC fan shut off. The wiring of the electric panel shut off is similar to the wiring for the HVAC fan shut off and may operate on a similar 24-volt current.

In one embodiment of the present invention, the controller includes a notification feature. In one such embodiment, the controller includes a cellular notification device that is wired to the relay 302. When the coil 304 in the relay 302 is energized, the cellular notification device places a call to notify the homeowner or other relevant person that the relay has been activated. The call may be a voice call to the homeowner or alternatively to an emergency dialing number, such as 911. The call may also be a short messaging service (SMS) message, email, or fax sent to various destinations, including the homeowner's cell phone. The call may also be a communication over satellite communication means.

In another embodiment, the controller containing the relay 302 includes a notification device that is connected to the public switched telephone network (PSTN). In such an embodiment, the notification device communicates over the PSTN to place calls, send email messages, or transmit faxes just as a cellular notification device would.

In an embodiment of the present invention, the relay includes a reset (not shown). The reset allows a homeowner or technician to reactivate or close the relay 302 manually. For example, if a minor fire occurs, and the homeowner is sure that the fan can now be reactivated, the homeowner uses the reset on the relay to allow the 24-volt circuit 308 to close.

Figure 4:
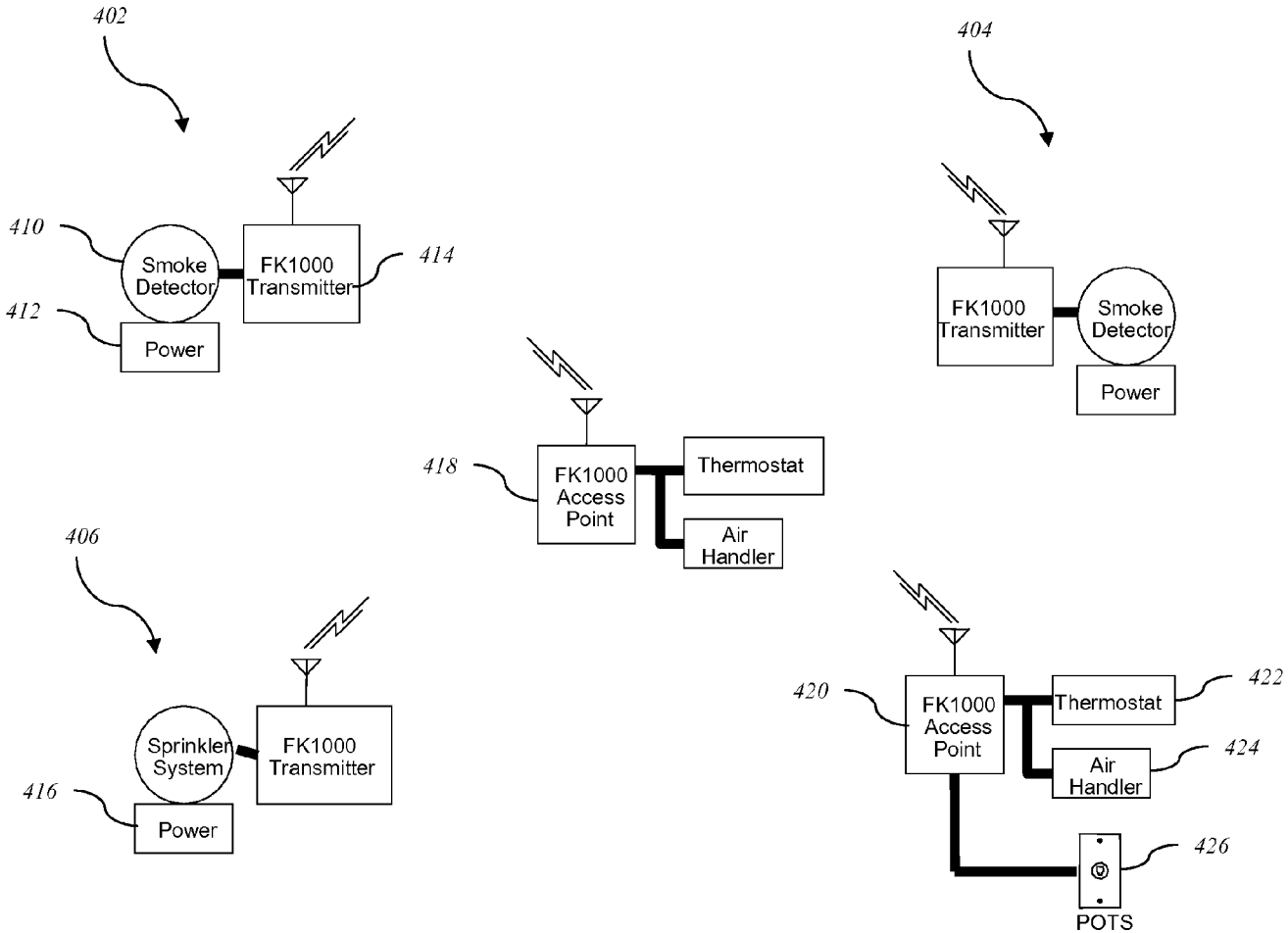
FIG. 4 is a block diagram, illustrating a plurality of fire signaling devices and access points in one embodiment of the present invention.

FIG. 4 is a block diagram, illustrating a plurality of fire signaling devices and access points in one embodiment of the present invention. The embodiment shown includes a plurality of fire signaling devices 402, 404, and 406. Fire signaling device 402 includes a smoke detector 410 for indicating the presence of a fire. The smoke detector 410 is connected to a power source 412, such as a 110-volt power supply in a residence. The smoke detector 410 is in communication with a transmitter 414. The connection between the smoke detector 410 and the transmitter 412 may be wired or wireless. The transmitter 412 monitors the smoke detector 410 constantly to determine if the smoke detector 410 is signaling the presence of a fire.

Fire signaling device 402 is representative of each of the plurality of fire signaling devices. Although many variations are possible. For example, fire signaling device 406 includes a sprinkler system 416 rather than a smoke detector to indicate the presence of a fire.

The embodiment shown in FIG. 1 also includes a plurality of access points 418 and 420. The access point 420 is connected to a thermostat 422, an air handler 424, and an external notification medium, such as the plain old telephone system (POTS) 426. The access point 420 is capable of generating a signal which turns off the air handler 424 thereby allowing more time for the occupants to escape a fire and reducing the amount of damage the fire causes. When a smoke detector 410 or other fire detection device, such as sprinkler system 416, has activity, it powers up the transmitter 414. The transmitter 414 sends a message via a communication channel, such as the RF ISM 902-927 MHz band or on a RS-485 multi-drop wired link. The transmitter 414 in the embodiment shown continues to transmit 414 a message periodically as long as the fire detection device is active.

The transmitter 414 and access point 420 may utilize any type of communication. In one embodiment, the communication mechanism is standardized so that different manufacturers' transmitters and access points are able to interact. In another embodiment, the transmitters are capable of transmitting a signal that is received by local emergency service providers when they approach the house, providing valuable information as to the location and status of active fire detection devices.

In the embodiment shown, the access point 420 receives the message and determines if it is valid. The current state of the fan and heater control signals are sampled and a shutdown sequence is initiated for the air handler 424. At the same time a modem in the access point 420 dials out through the POTS connection 426 to send an alarm message to a control center, neighbor, pager, or device that is connected to the POTS. In another embodiment, the access point 420 transmits a message over a network connection using TCP/IP. For example, if a home owner has digital subscriber line (DSL) access to the Internet, an embodiment of the present invention is able to utilize the high-speed connection to provide notification of a potential fire. In one embodiment including multiple access points, one access point serves as the notification server, and only that access point is attached to the external communication means, such as DSL.

As is shown in FIG. 4, an embodiment of the present invention may have multiple transmitters and access points. In one embodiment, the transmitters "chirp" about once per second with all of the access points listening for any alarm message. With all of the access points receiving any message all of the air handlers in the system will be shutdown in the event of any signaling device having an alarm. The transmitters use an anti-collision algorithm to prevent multiple devices sending at the same time, helping to ensure the messages get through from the transmitters to the access points.

A transmitter or access point according to the present invention may include one or more light-emitting diodes (LEDs) to reflect activity within the device. In one embodiment, the LEDs are mounted on the face of the device for easy viewing. The following table lists the conditions of the LEDs in one embodiment:

| LED | State | Condition |
|---|---|---|
| OFF | OFF | Not Ready |
| ON | Steady | Ready |
| ON | Blink | Alarm |

In one embodiment of the present invention, the access point 420 includes a user reset. The user reset allows for the user to stop the shutdown and notification. The number of resets and the time since the last reset may also be stored in a non-volatile memory (NOVRAM) for liability purposes. To allow the user enough time to get to the reset button, one embodiment includes two programmable delay values, which are set during installation. These are the shutdown delay and modem delay. The shutdown delay is the amount of time from a valid message to the start of the shutdown sequence. The modem delay is the amount of time from a valid message to a phone call being placed by the modem.

In the embodiment shown in FIG. 1, power for the fire signaling device 402 and access point 420 comes from the devices they are attached to. The power interfaces are versatile enough to be plugged into any AC or DC voltage, for example a 9 Volt battery in a smoke detector 410 or a 24 Volt current supplied by the thermostat 422 (24 Volts is the standard thermostat voltage). Preferably, the transmitters 414 and access points 420 are low power devices and consume little power. Also preferably, the power interface protects the device from any transients that could potentially cause damage.

Figure 5:
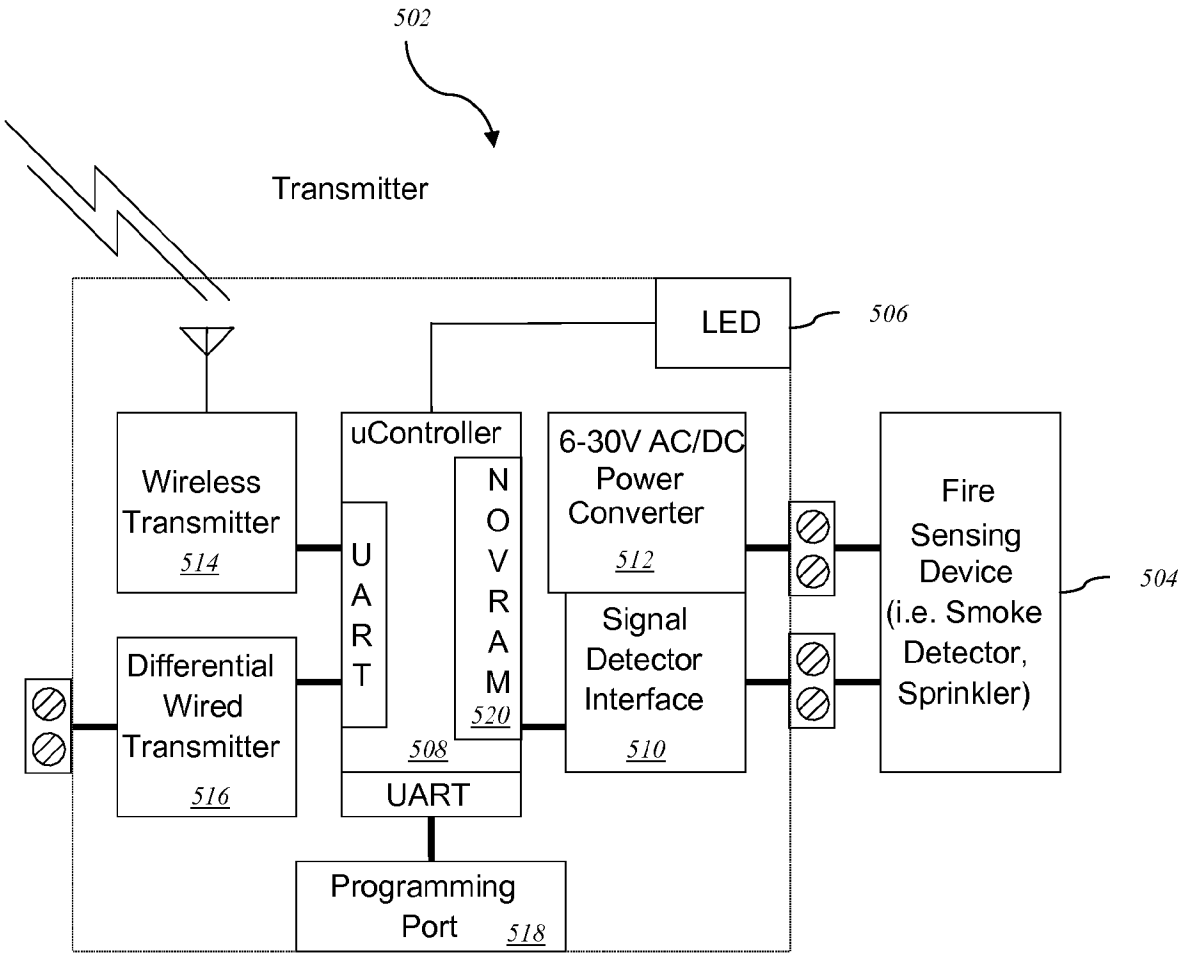
FIG. 5 is a block diagram of a transmitter in one embodiment of the present invention.

FIG. 5 is a block diagram of a transmitter in one embodiment of the present invention. The transmitter 502 detects an active signal from a fire-sensing device 504 and transmits continuously a message to an access point(s), such as the access points shown in FIG. 4. In the embodiment shown, the transmitter 502 includes a visible LED 506 to signal the current state of activity. The transmitter 502 also includes a programmable microcontroller (μC) 508 or other processor capable of interfacing to many different types of devices.

The transmitter 502 includes a signal detector interface 510 in communication with the fire signaling device 504. In the embodiment shown, the signal detector interface 510 is connected to the fire-signaling device 504 by a wire. In other embodiments, the interface 510 and signaling device 504 communicate wirelessly. The interface 510 isolates the signal from the rest of the transmitter circuitry using opto-isolation technology. This generic input allows for many different kinds of devices to be connected to the transmitter. The interface 512 in the embodiment shown allows any AC or DC signal from 6-30 Volts to be sampled by the microcontroller (μC) 508.

The transmitter 502 also includes a power converter 512. The power converter takes any AC or DC power source from 6-30 Volts and creates the necessary power for use in the transmitter circuitry. The input to the converter 512 is a bridge device with transient voltage suppression (TVS) circuitry. This allows for either an AC or a DC power source. The input power may come from an aftermarket smoke detector operating on batteries or a wired 24 VAC system. In one embodiment, with the transmitter 502 operating on low power, the alarm signal is used to power up the circuitry. In other embodiments, a larger input voltage range is allowed so that the transmitter 502 may be connected to home AC power sources (120-240 VAC). In yet another embodiment, the access point draws power from the POTS DC voltage for emergency purposes.

The transmitter 502 shown in FIG. 5 includes two separate transmitter sub-components in communication with the microcontroller 508, a wireless transmitter 514 and a wired differential transmitter 516. The wireless transmitter 514 in the embodiment shown is a radio capable of transmitting messages up to 300 feet. The radio transmits in the ISM frequency band of 902-927 MHz. The data to be sent modulates the carrier using FSK technology. The RF circuitry consists of a single chip transceiver, a quarter wave single pole wire antenna, and supporting passive components. The transceiver 514 is a programmable device with the ability to transmit the carrier at different frequencies. The setup and control of the transceiver 514 is performed with software running on the μC 508. Data to be sent through the transceiver 514 is not encoded (i.e. Manchester). The data is tightly packed and repeated sufficiently to remove the need for encoding.

The differential wired transmitter 516 in the embodiment shown is an optional interface for use in environments where the wireless transmitter 514 is ineffective. The differential wired transmitter 516 consists of a RS-485 multi-drop differential signaling IC. Setup or control of this interface 516 by the μC 508 is unnecessary. In one embodiment, the wiring of this interface 516 is of a star or daisy chain configuration with a distance of up to 1000 feet.

The transmitter 502 shown in FIG. 5 also includes a programming port 518, which is used to test and configure the transmitter 502 for use. In one embodiment, the programming port 518 is a simple three-wire RS-563 serial interface capable of connecting to any PC or terminal device. The port 518 may be used for production and field testing. The port 518 also provides a means of investigation after a fire has occurred to determine if the transmitter 502 detected an alarm and sent a message. An installer of a system according to the present invention uses the programming port 518 to setup the transmitter 502 for the device(s) that are attached to it, change frequencies, select wired or wireless modes, test the unit for proper operation, or perform various other setup, configuration, and maintenance procedures. The configuration values are stored in NOVRAM 510 in the μC 508.

The μC 508 is the main engine in the transmitter 502. The μC 508 detects the active alarm signal, controls the wireless 514 or wired transceiver 516, assembles the message, manages the anti-collision algorithm, stores information in NOVRAM 520, and interfaces to the programming port 518.

In the embodiment shown, the μC 508 is a single-chip device that has both digital and analog programmable components. All functions for the operation of the μC 508 are contained within the device. The μC 508 can either be programmed during manufacturing or by the installer, which, among other advantages, allows for updating the software/hardware configuration of the device in the field.

The μC 508 includes software. The software either operates in user mode or run mode. In the user mode, the control of the transmitter 502 is determined by the programming port 518. This allows for the user to setup the device, obtain status, and execute test software. The device parameters and status values are stored in NOVRAM 520. The following table lists the values utilized in one embodiment:

| Name | Type | Description |
|---|---|---|
| Alarm | Event | Alarm signal was detected on external interface |
| Alarm Time | Event | Amount of time since last alarm (external interface or valid message) |
| Detector Style | Parameter | Type of device connected to the signal detector interface |
| Wired | Parameter | Wireless/Wired communication link |
| RF Frequency | Parameter | Sets the carrier frequency of the RF link |
| ID | Parameter | Identification number of device |

Software executing on the μC 508 may perform a variety of functions. In one embodiment, the test software has two functions. The first is to enable a Go-No-Go (GONG) test to provide an indication of the basic level of functionality. The other is to test the wired or wireless link. These tests can only be initiated through the programming port. In one embodiment, the μC 508 executes a shell routine, which provides an interface in which an administrator or installer of the device accesses the configuration and other routines.

In the run mode the control of the transmitter 502 is automatic based on the setup values programmed into the NOVRAM 520. In the run mode, if the transmitter 502 receives an alarm, the transmitter continuously sends a message or messages.

In the embodiment shown in FIG. 5, the transmitter 502 is external to the fire sensing device 504. In another embodiment, the transmitter 502 is contained within the housing of the fire-sensing device 504.

Figure 6:
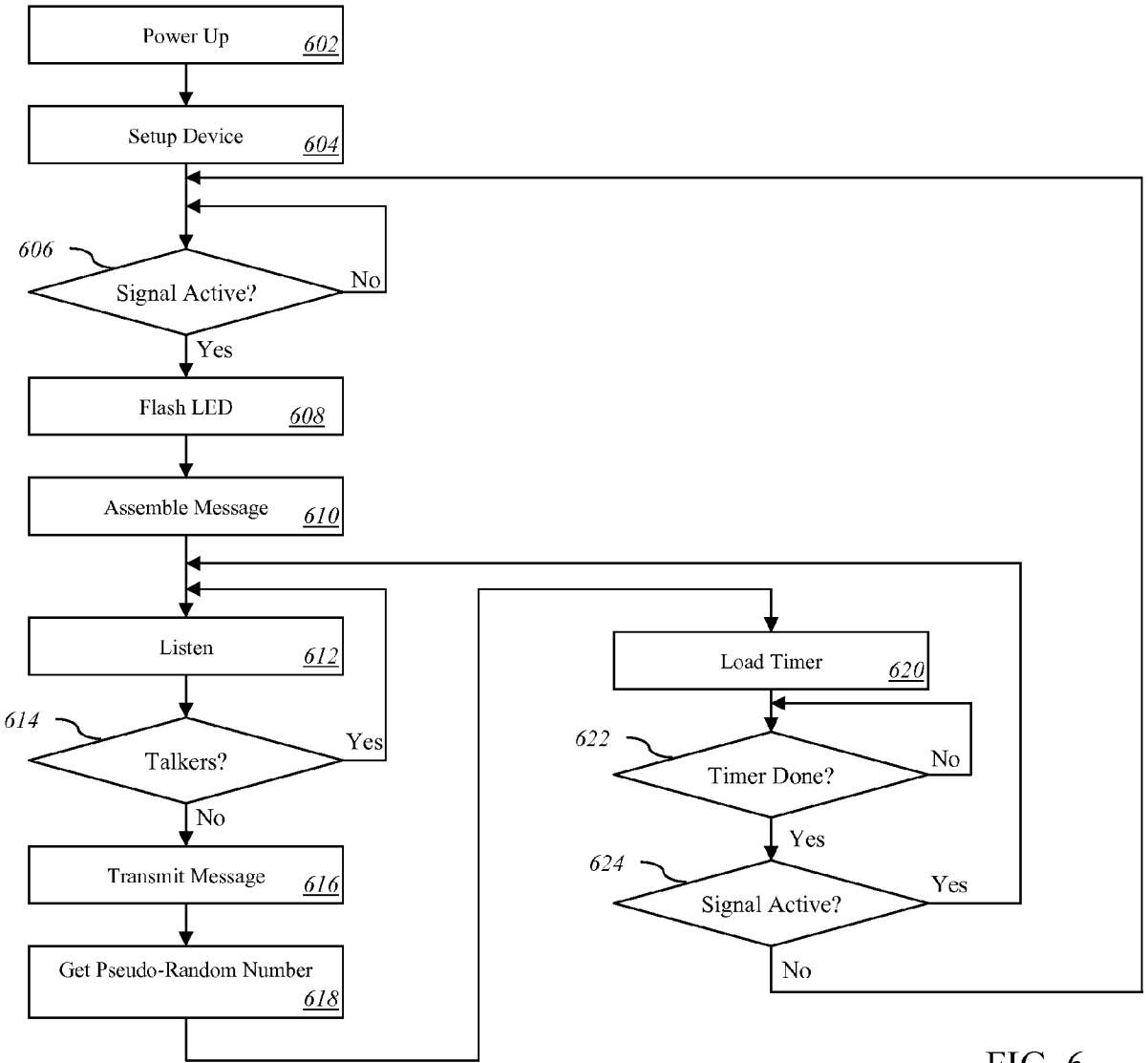
FIG. 6 is a flowchart illustrating the process that μC (508) executes for sending a message or messages in one embodiment of the present invention.

FIG. 6 is a flowchart illustrating the process that μC (508) executes for sending a message or messages in one embodiment of the present invention. The process includes an anti-collision algorithm that ensures that a message will get through to the access point. The μC (508) first powers up 502. The μC (508) then executes any setup routines that are necessary to begin monitoring a fire-sensing device 604. Subsequently, the μC (508) checks for an active signal from a fire-sensing device 606. If no active signal is detected, the μC (508) repeats the step of checking for the signal. If an active signal is detected, the μC (508) flashes the LED 608 and begins assembling a message for transmission. An access point will listen for the signal as described below.

Once the μC (508) has assembled the message, the μC (508) listens for a period of time to check for other transmitters 612. When there is silence, i.e., no talkers 614, the message is transmitted 616. A value is then read from a pseudo random number generator and is added to a timer of fixed duration, for example, a one second duration 618. The value being added can be either positive or negative. The pseudo-random number provides the timer a range of values equal to one second plus or minus the pseudo random number. The number is added to the timer, providing a pseudo-random interval 620. When the timer is complete 622, the μC (508) checks to see if the signal is still active 624. If so, the μC (508) prepares to send the message again, repeating the process beginning at step 612. Therefore a message will be transmitted by the μC (508) about once a second on average, but will typically not be transmitted at the same time another message is transmitted from another transmitter because the interval is substantially random.

The message is repeated to help ensure that the access point will receive the message. In other words, it is possible that because of collisions from packets received from various devices or because of interference, it is possible that an access point will not receive each and every message sent by a particular device. By repeating the message, the transmitter increases the likelihood of its message being received by an access point.

In one embodiment of the present invention, the message being transmitted consists of a header, message type, and device ID. Three of these messages are sent back-to-back for a complete message packet transmission. Each message has a length of nine bytes with a total message packet being 27 bytes or 216 bits. Each byte has an overhead of one start bit and one stop bit to give the overall message packet being 270 bits. With a transmission rate of 19.2 Kbps, the average time of transmission will be about 14 mS, allowing for about 70 devices to transmit at once a second with minimal collisions using the anti-collision algorithm. The message in such an embodiment is assembled as follows:

| Byte 1-4 | Byte 5 | Byte 6-9 |
|---|---|---|
| Header<br>55AA55AA Hex | Type<br>0 = Alarm<br>1 = Test | ID<br>32 bit ID<br>4 Billion possibilities |

The Header in the table above contains the message information from the transmitter. The Type allows an administrator or installer to send test messages. The ID identifies the transmitter and associated device to an access point receiving the signal.

Figure 7:
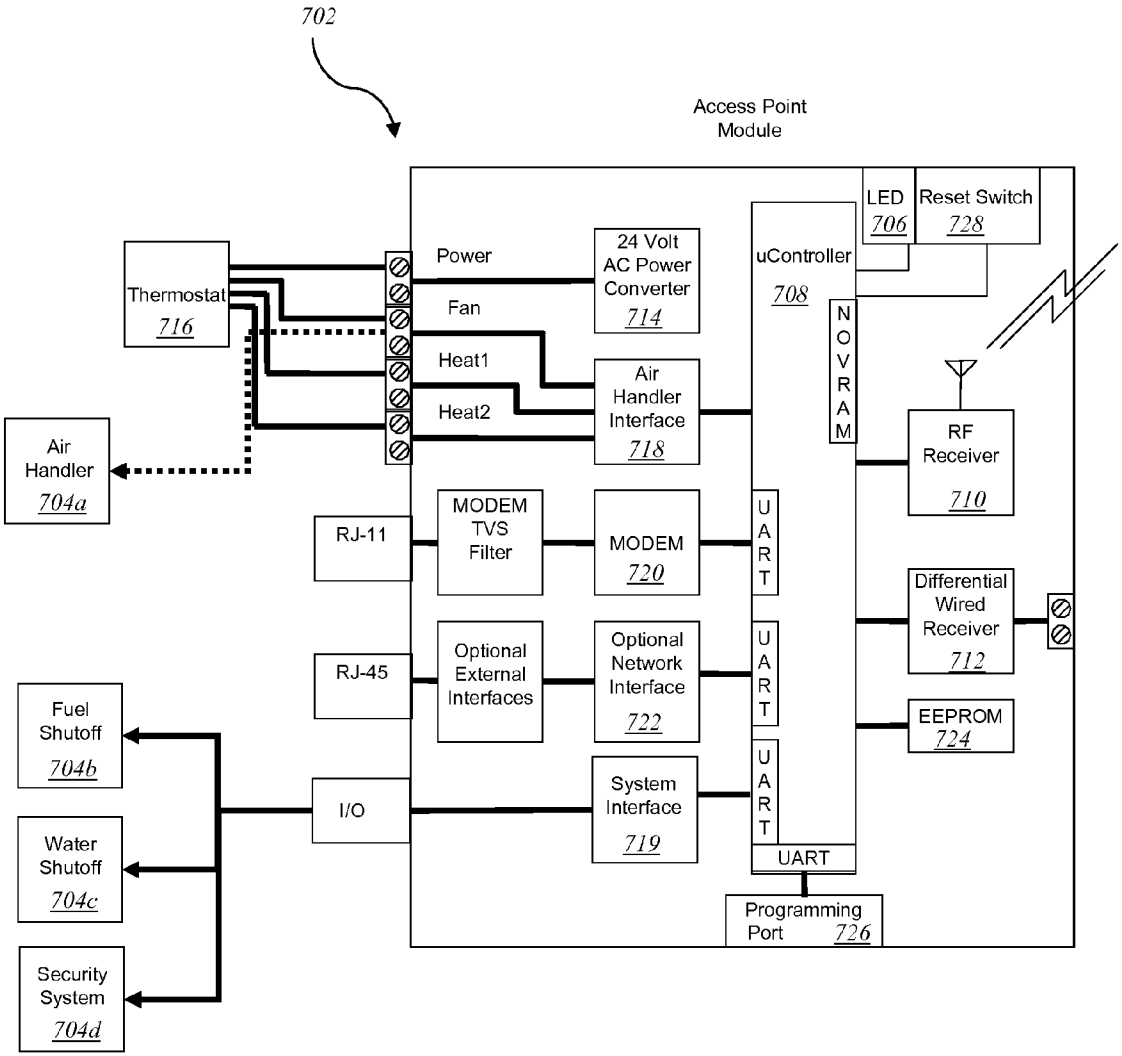
FIG. 7 is a block diagram illustrating the components of an access point in one embodiment of the present invention.

FIG. 7 is a block diagram illustrating the components of an access point in one embodiment of the present invention. The access point 702 receives a message from a transmitter (as described above) and sequences an air handler **704*a* for a complete shutdown. In the embodiment shown, the access point 704*a* also places a modem call, or transmits a message over a network link, in order to notify somebody of a problem occurring. A visible LED 706** on the access point signals the current state of activity (described above). The access point

702 includes a programmable μC 708 capable of interfacing to different types of air handlers and communication mediums.

The embodiment shown is also able to disable other types of devices. For example, the embodiment shown includes a fuel shutoff 704*b* and a water shutoff 704*c*. The number one cause of residential fires is the stove top. Smoke detectors can sense when there is a problem with the stove due to the amount of smoke cooking foods or oils generate. If the source of the smoke is turned off, the possibility of the fire spreading is reduced. The embodiment shown includes a solid state relay output (system interface 719) to allow for a low voltage to be applied to a shunt breaker or gas control valve to shut off the source of fuel to the stove. This relay interface will be normally open and be closed by the processor at the same time (after false alarm detection and programmed delay) the HVAC system is shut down. An external low voltage source like a transformer would be used to power the interface.

Sprinkler systems have been know to slow down and possibly put out fires in the early stages. But when there is a fire or accidental breakage, the water damage can far exceed the savings. The embodiment shown with the water detection option could shut off the water flow using the water shutoff 704*c* and/or notify someone if water is being released. The embodiment shown receives a signal from a water flow meter or control device from the sprinkler system. The microcontroller uses the same algorithm as it uses for the smoke detector interface and initiates a communication that the sprinkler system is active.

The access point 702 may also communicate with a security system 704*d*. Residential Security systems have a myriad of interfaces to detect such things as door openings, window breakage, motion, etc. These systems also have a low voltage interface to communicate with their own smoke detectors. These detectors are not the standard high voltage ones typically installed in homes. Due to having to use their own smoke detectors, there is additional cost and unwanted appearance in the home. The use of the device shown 702 with the security option may obviate the need for these additional smoke detectors. The embodiment shown includes a solid state relay controlled by the main processor which will allow an interface to communicate with the security system. This relay interface will be normally open and be closed by the processor at the same time (after false alarm detection and programmed delay) the HVAC system is shut down. The open/closed condition of the relay will be detected by the security system using pull-up/pull down resistors at the security system.

The access point 702 also includes a wireless receiver or transceiver 710. The wireless transceiver 710 consists of the same or similar circuitry as the transmitter shown in FIG. 5. In the embodiment shown, the transceiver 710 is fully programmable by a microcontroller (μC) 708. Unlike the transmitter shown in FIG. 5, the transceiver 710 of the access point 702 is in a constant listening mode. As the data is extracted from the carrier it is sent to the μC 708. A receive signal strength indicator (RSSI) is output from the transceiver. The RSSI is sampled for testing purposes when the system is setup, verifying that the transmitter's signal can reach the receiver.

In the embodiment shown in FIG. 7, the access point 702 also includes a differential wired receiver 712. The differential wired receiver 712 consists of the same circuitry as the differential wired transmitter shown in FIG. 5. The differential wired receiver 712 and transmitter are to be used in environments where the wireless interface is not capable of being used. The data received through this interface 712 is substantially identical to the data that outputs from the wireless transceiver.

The access point 702 also includes a power converter 714. The power converter 714 is also similar to the power converter shown in FIG. 5. It supplies power for the access point 702. The converter 714 shown is for use with the standard 24 VAC from a thermostat 716. However, other voltages may be utilized with minimal changes to the power converter 714. The embodiment shown in FIG. 7 does not include a battery backup since if the power is out, the air handler 704*a* will not need to be shut down. However, an embodiment in communication with an air handler that has a battery backup, would itself have a battery backup. In such an embodiment, the air handler and access point may be powered by the same alternative power supply (e.g., generator).

In the embodiment shown in FIG. 7, the access point 702 is connected by a wire to the air handler 704*a*. An air handler interface 718 converts the controls signals produced by the μC 708 to digital levels along with turning them ON or OFF. In one embodiment, the ability to control the fan and heat to the air handler is done with solid state relays (SSR). The use of these devices increases the reliability over traditional mechanical relays, although traditional mechanical relays may also be utilized successfully. The control of the SSR is from the μC 708 using digital levels. The SSR is able to handle a wide variety of voltage and current making them useful for a variety of air handlers. This circuitry is wired in series with the thermostat 716 to ensure that the air handler is shut down properly. In some embodiments, the access point 702 incorporates the thermostat 716. In such embodiments, the interface with the thermostat 716 may be completely in software. The access point 702 may also include a system interface for interfacing with the fuel shutoff 702*b* and the water shutoff 702*c*.

The access point 702 also includes a modem 720. The modem 720 is a plug-in device capable of transmitting data or voice over POTS. The modem 720 shown is a self contained device and is controlled by the μC 708. The setup and control of the modem 720 is accomplished through both a standard hardware and software interface with the μC 708. The hardware control is a simple request to send and clear and to send handshake data handled by the μC software. The software control is done using standard AT commands. The AT commands are executed by the software running on the μC 708. In one embodiment, once a connection is established, a text message is sent in standard ASCII format to a recipient. In another embodiment, a recorded audio message is sent by the modem 720.

The μC 708 is the same single chip device used on the transmitter. With its ability to program itself to different configurations, it reduces the cost of manufacturing by using the same part. Some of the digital and analog components used are UARTs, timers, and NOVRAM.

The μC software either operates in user mode or run mode. In the user mode the control of the transmitter is determined by the programming port. This allows for the user to setup the device, obtain status, or execute test software. The device parameters and status values are stored in NOVRAM. The following table lists these values:

| Name | Type | Description |
|---|---|---|
| Valid Message | Event | A valid alarm message was received |
| Reset | Event | User reset the system |
| Reset Number | Event | Number of resets since installation |
| Alarm Time | Event | Amount of time since last alarm (external interface or valid message) |
| Reset Time | Event | Amount of time since last reset |
| Shutdown Number | Event | Number of shutdown sequences since installation |
| Modem Number | Event | Number of modem calls since installation |
| Shutdown Delay | Parameter | Time delay from a valid alarm to shutdown sequence |
| Modem Delay | Parameter | Time delay from a valid alarm to the modem placing a call |
| Phone Numbers | Parameter | List of phone numbers to call in sequence |
| Air Handler Delay | Parameter | Time delay from shutting down the heat to shutting down the air handler |
| Pager Number | Parameter | Pager enabler and dial back sequence |
| Message | Parameter | Message (i.e. Name, Address, Phone number) to be sent through modem |
| TCP/IP Address | Parameter | Network address for optional TCP/IP interface |
| Voice Message | Parameter | Audio recording of voice alarm message for POTS |
| Wired | Parameter | Wireless/Wired communication link |
| RF Frequency | Parameter | Sets the carrier frequency of the RF link |
| ID | Parameter | Identification Number of Device |

In the embodiment shown in FIG. 7, an optional network interface 722 may transmit the notification message in place of the modem. In various embodiments, this network interface 722 is a HomePlug, 10/100 Ethernet, Bluetooth, or some other network connection. In the embodiment shown, the interface to the network interface 722 from the μC 708 is the same as it is for the modem 720. Conventional network interfaces have single chip solutions that contain all the necessary components as well as the TCP/IP stack to communicate on a network. In one embodiment, the network interface is used to set the access point up as a web server, enabling a home owner to access the interface 722 from any location via the Internet. Other interfaces, such as a cellular interface, may also be included in an embodiment of the present invention. However, the addition of interfaces may be constrained by the cost of a particular interface.

The embodiment shown also includes an electrically erasable programmable memory (EEPROM) 724. The EEPROM 724 provides additional NOVRAM for the storage of one or more voice recordings. Typically a recorded message for 10 seconds consumes up to 80 Kbytes. This EEPROM 724 is a serial device which allows for expanded the memory size without changing the interface. In such an embodiment, the voice is digitized and recorded on a PC then programmed in to the EEPROM 724 through the programming port 726. In another embodiment, the voice is digitized directly on the access point 702, allowing a user to easily record customized messages. The EEPROM 724 also provides storage for logging. The access point 702 logs actions taken by the access point 702 for archive purposes. For example, the EEPROM 702 may be accessed after a fire to determine whether a signal was received by the access point 702 and what steps the access point took in response.

The programming port 726 is similar to the one used on the transmitter. However, the setup parameters and the values stored in NOVRAM are different. The port 726 is used by the installer and user to setup the system, setup address and phone number lists, and store digitized voice recordings.

Test software may be executed on the access point 702. The test software has two functions. One is to run a Go-No-Go (GONG) test to give a basic level of functionality. The other is to test the wired or wireless link. These tests can only be initiated through the programming port.

In the run mode the control of the access point 702 is automatic based on the setup values programmed into the NOVRAM. The operation of the access point 702 will stop after a valid alarm message is detected, air handler is shutdown, and the message is sent. To start the access point 702 back up listening for a message, a user must power cycle the unit or press the reset button 728. The reset button 728 may be used by a user to reset the access point 702 after a false alarm, such as when a smoke detector sounds an alarm because a piece of toast has been burned. A delay between receiving the alarm signal and shutting down the air handler 704*a* or sending a notification message ensures that the user has time to reset the access point 702 after a false alarm. The reset switch 728 may also cause a signal to be transmitted over the system interface 719. For example, the reset switch 728 may cause a signal to be sent through the system interface 719 to the water shutoff 704*c*, causing water from the sprinkler system to shut off in the case of a false alarm to potentially mitigate water damage in the case of a false alarm.

Figure 8A:
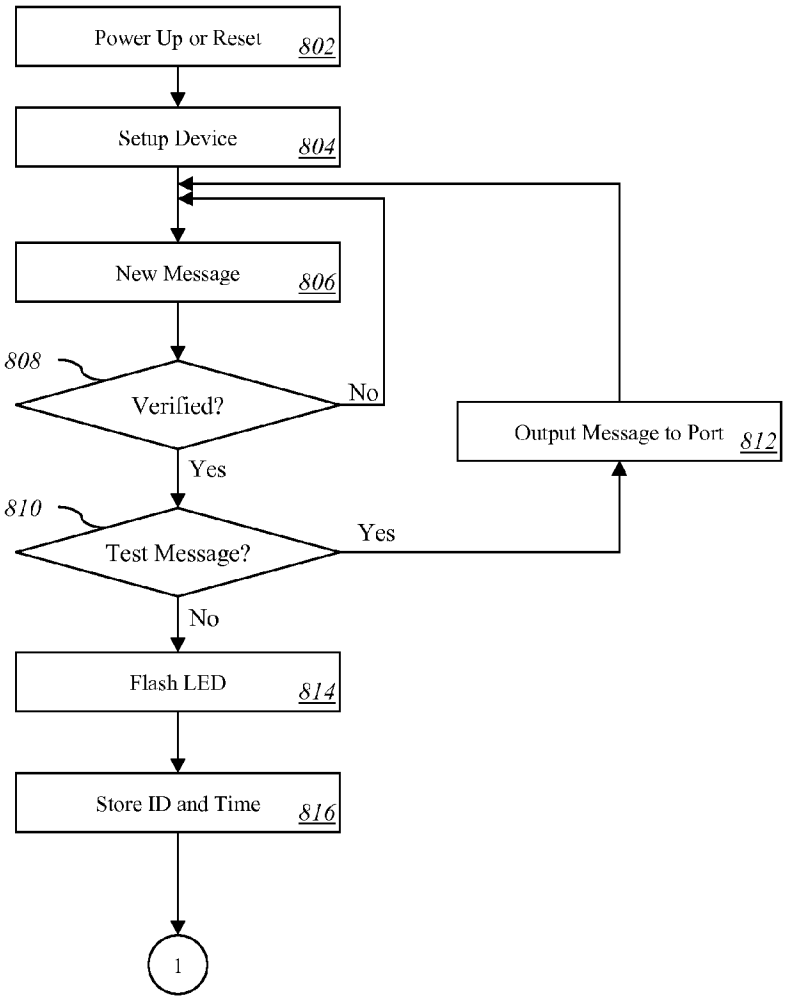
FIGS. 8A and 8B are a flowchart illustrating the process performed by the access point 702 in one embodiment of the present invention.
Figure 8B:
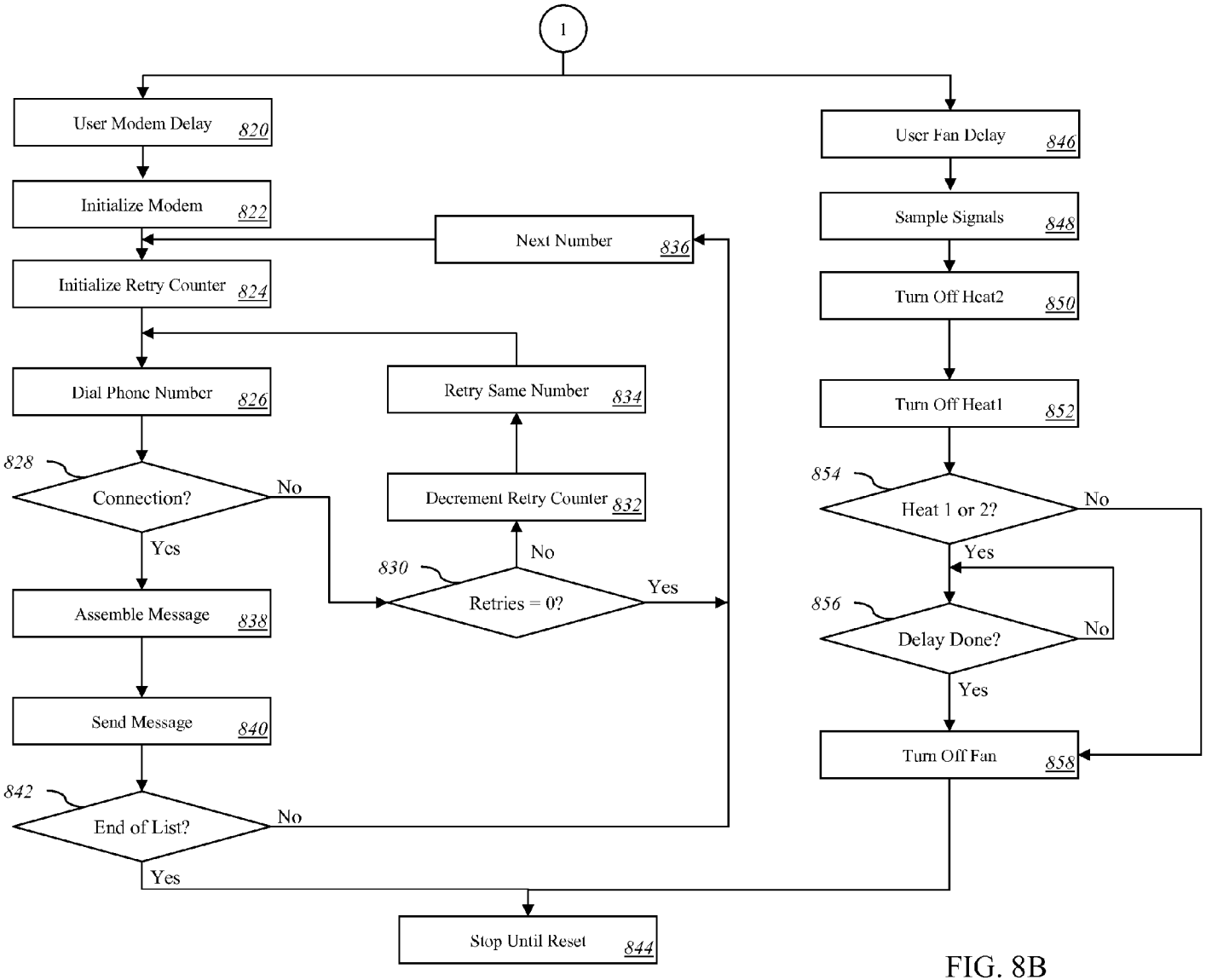

FIGS. 8A and 8B are a flowchart illustrating the process performed by the access point (702) in one embodiment of the present invention. The access point is first powered up o reset 802. A user, administrator, or technician then performs any necessary setup of the device 804. The access point is now ready to receive messages.

When the access point receives a message 806, the access point performs a message verification process 808. In one embodiment, the message verification process scans for the header sequence of 55AA55AA before it looks at the rest of the message. Once it finds this sequence, the next five bytes are read and a decision is made. If the message is not verified because, for example, the message is intended for some other device, the access point begins waiting for other new messages 806. If the message type is verified, the access point determines whether it is a test message or an alarm 810. If it is a test message, the message is sent to the programming port so that it can be evaluated by a user 812, and the access point begins waiting for new messages.

If the message is not a test message, it is an alarm message. In response to an alarm message, the access point flashes an LED (814). The access point next stores the ID and time 816 of the message. This information may provide valuable information to an investigator after a fire has occurred. In the embodiment shown in FIG. 8A, the access point next begins two parallel processes.

The access point first performs a user modem delay 820. The modem delay provides the user with an opportunity to reset the access point before it issues an alarm in the event that a false alarm triggered the access point. Once the delay interval has expired, the access point initializes the modem 822 and initializes a retry counter 824. The retry counter provides a mechanism for trying a telephone number multiple times in the event that an initial or subsequent attempts are unsuccessful.

In the embodiment shown, the access point next instructs the modem to dial a phone number 826. If the connection is unsuccessful 828, the access point determines whether additional retries should be made 830. If so, the access point decrements a retry counter 832 and sets the modem to retry dialing the same number 834. The access point then repeats steps 826-834 until the retry counter is equal to zero. When the retry counter is equal to zero, the access point attempts to try the next phone number in the list of numbers to be called in the event of an alarm 836.

If a connection is made, the access point assembles a message 838 and sends the message 840. Assembling the message may include creating a text message to be sent to a computer, cell phone, or other handheld device, creating an audio message to be delivered to a phone, or creating some other type of message based on user parameters. In one embodiment, the message sent out through the modem is a set of ASCII characters programmed into the access point by the user. The standard set in such an embodiments consists of name, address and telephone number. The message may contain coordinates or any other information concerning the location of the unit. In another embodiment, the message is a DTMF sequence for a pager to call back on. In yet another embodiment utilizing a network interface, the message may be an email or a message displayed on a terminal. The message may also be a voice recording to send to a person who does not have data connection or to a multimedia terminal.

In the embodiments shown in FIGS. 8A and 8B, the user may create a list of multiple numbers that should all be called in the event of an alarm. When the access point completes sending a message, the access point determines whether it has reached the end of the list 842. If not, the access point retrieves the next number and repeats steps 824-840. If so, the access point stops processing until it is reset 844.

In the embodiment shown in FIGS. 8A and 8B, the access point performs the notification procedure while simultaneously performing the shutdown sequence. The shutdown sequence is critical for some air handlers. For example, in some high efficiency units, the fan needs to run for about 90 seconds after the heat is turned off to prevent damage to the exchange unit. The user can adjust this turn off delay for different air handler units. Once the heat is turned off and the delay is complete, the fan may be turned off. The time the fan is left on should not force enough air into the room to cause the fire to expand.

In the embodiment shown, the access point first performs a user fan delay 846. As with the user modem delay, the user fan delay provides the user with the opportunity to reset the device to avoid shutting down the fan in response to a false alarm. The current state of the fan and heater controls signals are sampled and a shutdown sequence is initiated for the air handler 848. In the embodiment shown, the heating system includes two-stage heating, heat 1 and heat 2. In such an embodiment, the access point first turns off heat 2 850, and then turns off heat 1 852. If heat 1 or heat 2 were on prior to the shutdown process, the access point performs a delay 854. The delay repeats until the delay interval has elapsed 856. Once the delay has elapsed, or if neither heat 1 nor heat 2 were on, the access point turns off the fan 858. The access point then stops until reset 844.

The supplier of a fire suppression system according to the present invention may sell the transmitter and access point as a package or sell the components individually. And as described herein, a homeowner may utilize any combination of transmitters and access points based on the number of fire-detection devices and air handlers in the home. In one embodiment, the supplier sells the equipment, and the customer is responsible for no recurring charges. In another embodiment, the supplier provides the equipment for free, but charges the customer a monthly monitoring charge for monitoring messages from the customer's access point.

The foregoing description of the preferred embodiments of the invention has been presented only for the purpose of illustration and description and is not intended to be exhaustive or to limit the invention to the precise forms disclosed. Numerous modifications and adaptations thereof will be apparent to those skilled in the art without departing from the spirit and scope of the present invention.

That which is claimed:

1. A thermostat comprising:

an HVAC interface in communication with a residential HVAC system;

a receiver operable to receive a signal indicating the presence of a contaminant from an environmental condition detector; and a processor in communication with the receiver and the residential HVAC system and operable to receive a signal from the receiver, and in response, send a signal to the HVAC interface to cause the residential HVAC system to be shut down.

2. The thermostat of claim 1, wherein the contaminant comprises at least one of: smoke, carbon monoxide, or carbon dioxide.

3. The thermostat of claim 1, further comprising a fuel shutoff interface in communication with the processor.

4. The thermostat of claim 1, further comprising a water shutoff interface in communication with the processor.

5. The thermostat of claim 1, further comprising a security system interface in communication with the processor and with a security system.

6. The thermostat of claim 1, wherein the receiver comprises a wireless receiver.

7. The thermostat of claim 1, further comprising a modem in communication with the processor.

8. The thermostat of claim 1, wherein the environmental condition detector comprises one of: a smoke detector, a sprinkler system, or a carbon monoxide detector.

9. The thermostat of claim 1, further comprising a reset.

10. The thermostat of claim 9, wherein the reset is in communication with a water shutoff in a sprinkler system.

11. A method for suppressing the spread of contaminants, the method comprising:

receiving a message at an access point message indicating detection of a contaminant by an environmental condition detector;

initiating an automated shut down procedure for the residential HVAC system in response to the message; and initiating an automated shut down procedure at a system interface; wherein the automated shutdown procedure causes a fuel supply to shut down.

12. The method of claim 11, further comprising:

receiving a signal from the environmental condition detector indicator indicating the presence of a contaminant;

generating the message indicating the reception of the signal; and transmitting the message.

13. The method of claim 11, further comprising performing a notification procedure.

14. The method of claim 13, wherein the notification procedure comprises:

initiating a connection;

assembling a notification message; and transmitting the notification message.

15. The method of claim 14, wherein transmitting the notification message comprises transmitting the notification to a security system.

* * * * *

UNITED STATES PATENT AND TRADEMARK OFFICE

CERTIFICATE OF CORRECTION

PATENT NO. : 7,696,891 B2
APPLICATION NO. : 11/956955
DATED : April 13, 2010
INVENTOR(S) : Paul K. Whitney It is certified that error appears in the above-identified patent and that said Letters Patent is hereby corrected as shown below:

On the Title Page, Item (73) line 1, please delete "LLP", please insert -- LLC --.

Signed and Sealed this

Seventh Day of September, 2010

David J. Kappos

David J. Kappos
*Director of the United States Patent and Trademark Office*